United States Patent [19]

Morita et al.

[11] 4,262,492

[45] Apr. 21, 1981

[54] AIRCONDITIONER

[75] Inventors: Keiichi Morita; Tetsuo Kobayashi, both of Fujinomiya; Takeshi Matsuo, Fuji, all of Japan

[73] Assignee: Tokyo Shibaura Denki Kabushiki Kaisha, Kawasaki, Japan

[21] Appl. No.: 56,082

[22] Filed: Jul. 9, 1979

[30] Foreign Application Priority Data

Jul. 20, 1978 [JP] Japan ..... 53-88554

[51] Int. Cl.[3] ..... F25B 13/00; F25B 31/00

[52] U.S. Cl. ..... 62/324.6; 62/505

[58] Field of Search ..... 62/324 A, 469, 503, 62/505, 509

[56] References Cited

U.S. PATENT DOCUMENTS

| | | | |
|---|---|---|---|
| 2,247,950 | 7/1941 | Kucher | 62/505 |
| 2,921,445 | 1/1960 | Ashley et al. | 62/505 |
| 2,921,446 | 1/1960 | Zulinke | 62/505 |
| 3,006,163 | 10/1961 | Kooiker | 62/505 |
| 3,111,820 | 11/1963 | Atchison | 62/505 |
| 3,158,009 | 11/1964 | Rayner | 62/505 |
| 3,217,193 | 11/1965 | Rayner | 62/505 |

*Primary Examiner*—Lloyd L. King

*Attorney, Agent, or Firm*—Cushman, Darby & Cushman

[57] ABSTRACT

An airconditioner consists of heat pump type freezing cycle equipment comprising a rotary compressor having a guide port open to the interior of its cylinder; a refrigerant flow-changing valve; an indoor heat exchanger; a first decompressing device; a gas-liquid separator; a second decompressing device; an outdoor heat exchanger, all communicating with each other in the order mentioned. And an injection passage in the guide port communicates with the gas-liquid separator so that a gas refrigerant is injected from the gas-liquid separator into the cylinder through the guide port.

3 Claims, 3 Drawing Figures

AIRCONDITIONER

This invention relates to improvements on a heat pump type air conditioner capable of interchangeably carrying out the cooling and heating of rooms.

At present, an air conditioner is widely accepted which interchangeably carries out the cooling and heating of rooms by utilizing a heat pump type freezing cycle equipment. With this type of air conditioner, a compresser included in freezing cycle equipment consumes the largest proportion, for example 80 to 90% of the total power requirement of the air conditioner, and moreover is most responsible for the occurrence of operation noises. The compressor efficiency is expressed in the ratio of a freezing capacity to power consumption. This ratio is also referred to as a coefficient of performance (abbreviated as "COP"). Particularly during the room-cooling cycle, the energy efficiency ratio (abbreviated as "EER") bears a great importance. The compressor is classified, as is well known, into the reciprocation type and rotation type. Needless to say, the rotation type has a higher efficiency and produces fewer noises during operation than the reciprocation type.

Elevated compressor efficiency resulting from technical development has noticeably increased the cooling capacity of an air conditioner, sometimes even giving rise to a harmful effect on the health of the user due to excessive cooling. Therefore, difficulties are presented in properly controlling the operation of an air conditioner. Conversely, where an air conditioner has its operation changed over to room heating, its heating efficiency is largely affected by atmospheric temperature. Where the outdoor temperature indicates a particularly low level the air conditioner fails to produce the desired heating effect, even when the compressor is run at a high efficency. As things stand at present, therefore, the rotation type compressor of an air-conditioner tends to be run at too high an efficiency for room cooling, whereas its operating efficiency has to be considerably raised for room heating.

Regardless of the application of an air conditioner either for cooling or heating, the compressor generally tends to be overheated due to hot gas compressed in the cylinder being carried into the compressor case. Since this overheating damages the freezing capacity of the compressor, various processes have been attempted to reduced said overheating. As a result, it has become possible to decrease the temperature of an overheated compressor to a desired level. However, all the attempted overheating-reducing processes have caused room-heating energy to be thrown off into the atmosphere, thereby resulting in enthalpy loss and consequently a noticeable loss in the room-heating capacity of an air conditioner.

This invention has been accomplished in view of the above-mentioned circumstances, and is intended to provide an air conditioner which can interchangeably carry out the cooling and heating of rooms at a high efficiency with the energy efficiency ratio (EER) improved during room cooling, and in which the overheating of the rotation type compressor can be properly reduced.

This invention can be more fully understood from the following detailed description when taken in conjunction with the accompanying drawings, in which.

Figure 1:
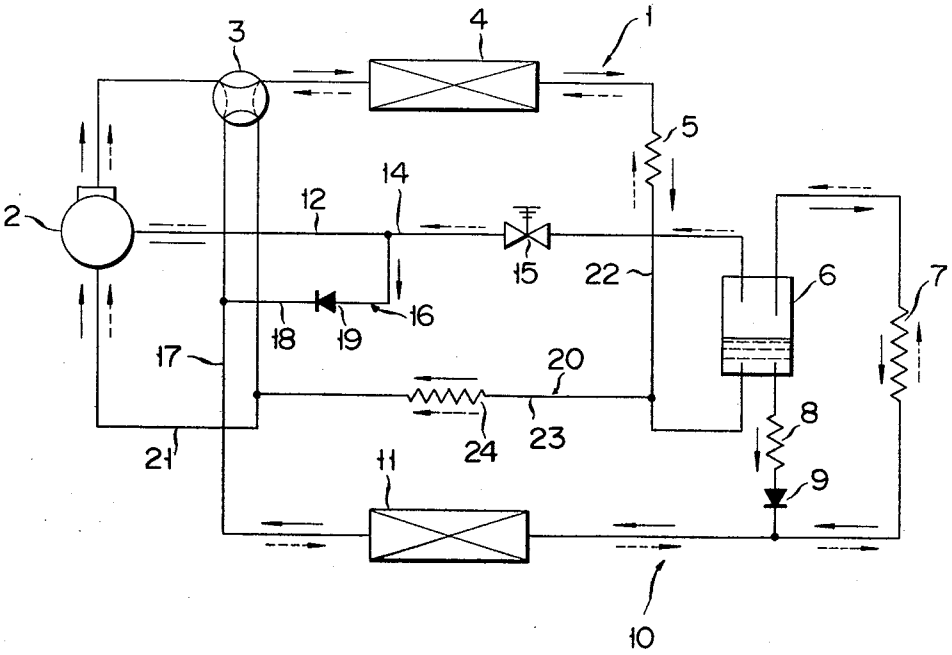
FIG. 1 shows the arrangement of the freezing cycle equipment of an air conditioner embodying this invention.

FIG. 1 indicates the arrangement of the freezing cycle equipment used with an air conditioner embodying this invention. General reference numeral 1 denotes room-cooling freezing cycle equipment. This room-cooling freezing cycle equipment 1 comprises a rotary compressor 2, refrigerant flow-changing valve 3 of the four-way type, outdoor heat exchanger 4, main capillary tube 5, gas-liquid separator 6, auxiliary capillary tube 7, room-cooling capillary tube 8 and room-cooling check valve 9. Freezing cycle equipment 10 used when the compressor is of the heat pump type consists of the room-cooling cycle equipment 1 and indoor heat exchanger 11. The above-listed devices communicate with each other by means of a refrigerant pipe 17. The outdoor and indoor heat exchangers 4, 11 are provided with mutually facing blowers (not shown). Heat-exchanged air streams are carried into or out of the room.

Reference numeral 12 denotes an injection-release system, which consists of a connector pipe 14 for effecting communication between the later described guide port 13 (FIG. 2) and gas-liquid separator 6, and a two-way changeover valve 15 set at an intermediate point of the connector pipe 14. Reference numeral 16 denotes a release passage extending from the injection-release passage 12 to a refrigerant pipe 17 to effect communication between the indoor heat exchanger 11 and refrigerant flow-changing valve 3. The release passage 16 consists of a connector pipe 18 for effecting communication between the refrigerant pipe 17 and the connector pipe 14 and a stop valve 19 set at an intermediate point of the connector pipe 18. Reference numeral 20 denotes a liquid by-pass, which consists of a refrigerant pipe 21 for effecting communication between the suction side of the compressor 2 and refrigerant flow-changing valve 3, a connector pipe 23 fitted to a refrigerant pipe 22 for effecting communication between the main capillary tube 5 and gas-liquid separator 6, and a bypass capillary tube 24 disposed at an intermediate point of the connector pipe 23.

Figure 2:
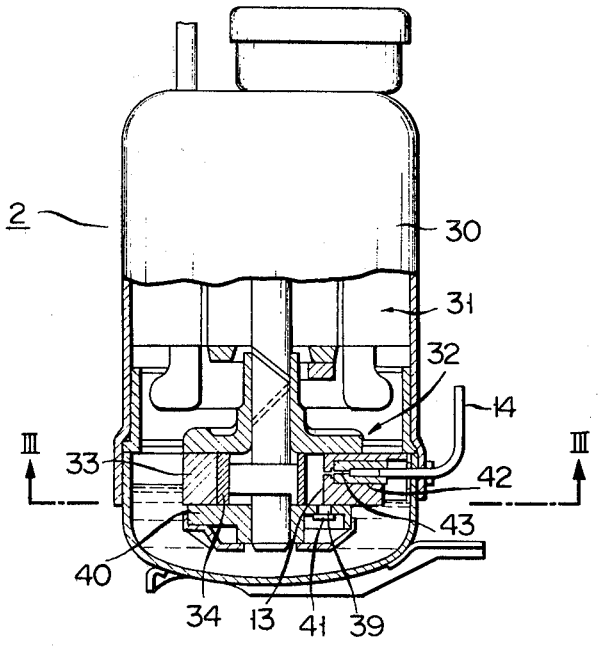
FIG. 2 is a front view, partly in section of a rotary compressor used with the air conditioner of the invention.
Figure 3:
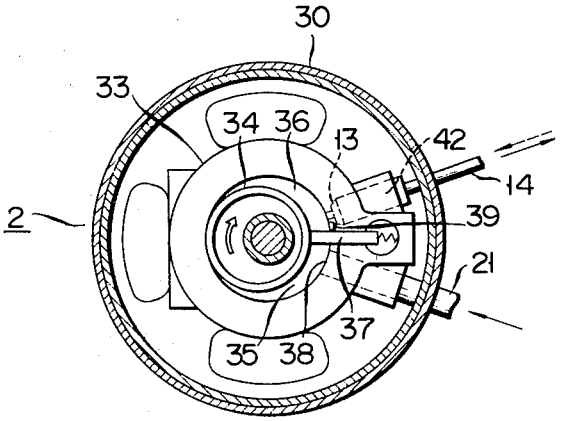
FIG. 3 is a sectional view on line III—III of FIG. 2.

There will now be described by reference to FIGS. 2 and 3 the main arrangement of the compressor 2. This compressor 2 comprises an electric motor section 31 provided in the upper interior portions of a sealed casing 30 and an adjacent compressor section 32 disposed in the lower interior portion of said casing 30. The compressor section 32 comprises a cylinder 33, a rotor 34 received in the cylinder 33 to be eccentrically rotated, and a blade 37 whose outer end always abouts against the inner peripheral wall of the rotor 34 to divide the inner space of the cylinder 33 into two chambers 35, 36. A suction port 38 formed at one end of the refrigerant pipe 21 is opened to one (suction) chamber 35 of the cylinder 33 defined by the blade 37. Opened to the other (compression) chamber 36 of the cylinder 33 is a discharge port 39 which is formed in a bearing 40 supporting the lower portion of the cylinder 33, and opened and closed by a discharge valve 41. That portion of the inner peripheral wall of the cylinder 33 which lies near the discharge port 39 is provided with the aforesaid guide port 13 (FIG. 2). This guide port 13 communicates with the injection-release passage 12 through a guide mechanism 42.

The guide port 13 of the guide mechanism 42 occupies a suitable position in the peripheral wall of the cylinder 33 to ensure a balance between the timing of injection and that of release. The guide port 13 is provided with a throttle section 43 to enable a proper amount of gas to be injected and also to prevent high pressurized gas from flowing backword from the guide port 13 during injection. The throttle section 43 of the guide port 13 may be replaced by the stop valve 19. Or it is possible to form a guide port 13 in the end face of the cylinder 33 and cause the guide port 13 to be opened or closed by the end face of the rotor 34 when it is eccentrically rotated.

There will now be described the operation of the air conditioner of this invention constructed as described above.

Now let it be assumed that the air conditioner is operated for a cooling cycle with a cool-heat switch thrown to the cooling side. A hot highly compressed gas refrigerant delivered through the discharge port 39 of the compressor 2 passes through the refrigerant flow-changing valve 3 in the direction of a solid line arrow indicated in FIG. 1 into the outdoor heat exchanger 4 which releases the heat of the gas refrigerant. As a result, the gas refrigerant is changed into a highly compressed liquid refrigerant. This highly compressed liquid refrigerant is decompressed by the action of the main capillary tube 5. The greater part of the decompressed liquid refrigerant is conducted to the gas-liquid separator 6, and part of said refrigerant is carried into the liquid refrigerant by-pass 20. The gas-liquid separator 6 acts as a sort of liquid tank and separates a gas refrigerant from a liquid refrigerant to control the flow rate of a refrigerant. The separated gas refrigerant enters the auxiliary capillary tube 7, and the separated liquid refrigerant flows into the room-cooling capillary tube 8. While passing through the capillary tubes 7, 8, the gas and liquid refrigerants converge in a decompressed state. After convergence, the decompressed liquid refrigerant is carried into the indoor heat exchanger 11 to be evaporated. The temperature of the air of a room to be air conditioner drops to an extent corresponding to the evaporation latent heat of the liquid refrigerant, thereby ensuring room cooling. The evaporated refrigerant is brought into the compressor 2 through the refrigerant flow-changing valve 3.

During the cooling cycle, the two-way refrigerant flow-changing valve 15 remains closed. Therefore, the pressure of a refrigerant drops on the outlet side of the stop valve 19 communicating with the suction side of the compressor 2 and rises on the inlet side of said stop valve 19. Therefore, a decrease in the capacity of the compressor 2 and an increase in the EER can be ensured by conducting part of a gas refrigerant in the process of being subjected to adiabatic compression from the guide port 13 to the connector pipe 14 through the guide mechanism 42. Thereafter, the gas refrigerant flows from the connector pipe 14 to the release passage 16 and then to the compressor 2.

A liquid refrigerant carried into the liquid refrigerant by-pass 20 is mixed with a gas refrigerant sent forth from the release passage 16 and indoor heat exchanger 11. As a result, a cool gas refrigerant is carried into the compressor 2 to prevent its overheating.

Now let it be assumed that a cool-heat switch (not shown) is thrown to the heating side. Then, a refrigerant discharged from the compressor 2 is conducted in the direction of a dotted line arrow indicated in FIG. 1 to the indoor heat exchanger 11 through the refrigerant flow-charging valve 3. The refrigerant is condensed into a liquid refrigerant by the heat exchanger 11. At this time, the heat exchanger 11 releases the condensation heat of the refrigerant into a room being air conditioner for heating. Thereafter, the liquid refrigerant flows into the auxiliary capillary tube 7 to be decompressed. When entering the gas-liquid separator 6, the refrigerant is divided into gas and liquid phases. Pressure in the gas-liquid separator 6 is maintained at a level of about 8 to 10 kg/cm$^2$ intermediate between a high level of 20 kg/cm$^2$ and a low level of 4 kg/cm$^2$. The liquid refrigerant is mostly carried into the main capillary tube 5 and has its pressure decreased. Part of the liquid refrigerant is conducted to the liquid refrigerant by-pass 20. Then entering the outdoor heat exchanger 4 through the main capillary tube 5, the liquid refrigerant is evaporated by said heat exchanger 4 and then brought into the compressor 2.

During the room-heating cycle, the refrigerant flow-changing valve 15 is left open. Consequently, a gas refrigerant delivered from the gas-liquid separator 6 flows to the injection-release passage 12. An increase in the amount of a refrigerant discharged from the compressor 2 and the elevation of the room-heating capacity of the subject air conditioner are ensured by ejecting a gas refrigerant into a gas in the process of subjected to adiabatic compression through the guide port 13 formed in the compressor 2. A refrigerant on the outlet side of the release valve 19 which communicates with the high pressure discharge side of the compressor 2 has a high pressure. Therefore, part of the gas refrigerant delivered from the injection-release passage 12 can not enter the release passage 16. Consequently, the release valve 19 remains closed, preventing its outlet side from communicating with the discharge side of the compressor 2. The liquid refrigerant conducted to the liquid refrigerant by-pass 20 is mixed with the gas refrigerant leaving the outdoor heat exchanger 14 and drops in temperature. The liquid refrigerant thus cooled enters the compressor 2 to supress its overheating.

As described above, the rotary compressor 2 used with an air conditioner embodying this invention is provided with a guide port 13 open to the interior of the cylinder. During the cooling cycle, a gas in the process of being compressed flows to the suction side of the compressor through said guide port, thereby ensuring the release of a highly compressed gas. During the heating cycle, a gas is injected into the cylinder through said guide port, thus enabling the enthalpy to be increased. The air conditioner of the invention can have its cooling and heating capacities varied as desired and is improved in the energy efficiency ratio (EER) during the cooling cycle and also in its heating capacity.

The guide port 13 communicates with the gas-liquid separator 6 through the injection-release passage 12. Received in this passage 12 is a valve which is closed during the cooling cycle and opened during the heating cycle. The injection-release passage 12 communicates with the suction side of the rotary compressor 2 through the release passage 16. Provided in this release passage 16 is a release valve 19 which, during the cooling cycle, conducts a gas flowing out of the guide port 13 to the suction side of the compressor 2, and, during the heating cycle, remains closed. Accordingly, the air conditioner of this invention can have its cooling and heating capacities varied as desired by a very simple arrangement and is improved in the energy efficiency ratio (EER) during the cooling cycle and also in its heating capacity.

A liquid refrigerant by-pass 20 communicating with the gas-liquid separator 6 is provided on the suction side of the rotary compressor 2 to allow a liquid refrigerant to flow into the rotary compressor during both cooling and heating cycle. Consequently the rotary compressor always remains cooled and is saved from overheating.

What we claim is:

1. An air conditioner having heat pump type refrigeration cycle components, comprising a rotary compressor having a compression side, a suction side and a guide port open to the interior of its cylinder, a refrigerant flow-changing valve, an indoor exchanger, a decompressing device, a gas-liquid separator and an outdoor heat exchanger, all communicating with each other for fluid flow therethrough in the above recited order; an injection passage by which the guide port communicates with the gas-liquid separater and a portion of gas refrigerant is injected from said gas-liquid separater into the cylinder through said guide port; and a release passage having a first end and a second end connected between said indoor heat exchanger and the suction side of said compressor at said first end and said injection release passage at said second end, said release passage including means for releasing a portion of gas refrigerant being compressed in the said compressor and returning said portion to the suction side of said compressor.

2. An air conditioner as in claim 1, further comprising a liquid refrigerant bypass for effecting communication between the suction side of the compressor and the gasliquid separater to conduct a liquid refrigerant from the gas-liquid separater to the compressor during both cooling and heating cycles.

3. The air conditioner as in claim 1 wherein said compressor conducts gas in the process of being compressed to the suction side of the compressor through the gas port during the cooling cycle and injects refrigerant into the cylinder through the guide port during the heating cycle.

* * * * *